United States Patent [19]

Schwartz et al.

[11] 4,203,337

[45] May 20, 1980

[54] LARGE SCALE INTEGRATED CIRCUIT CHIP FOR AN ELECTRONIC ORGAN

[75] Inventors: Harold O. Schwartz, Elburn; Dennis E. Kidd, Sycamore, both of Ill.

[73] Assignee: The Wurlitzer Company, DeKalb, Ill.

[21] Appl. No.: 917,313

[22] Filed: Jun. 20, 1978

[51] Int. Cl.[2] ..... G10H 1/06; G10H 5/06; G10H 5/10

[52] U.S. Cl. ..... 84/1.01; 84/1.23; 84/1.26

[58] Field of Search ..... 84/1.01, 1.03, 1.13, 84/1.22, 1.23, 1.26

[56] References Cited

U.S. PATENT DOCUMENTS

| | | | |
|---|---|---|---|
| 3,610,799 | 10/1971 | Watson | 84/1.01 |
| 4,070,943 | 1/1978 | Faulkner | 84/1.01 |
| 4,083,286 | 4/1978 | Faulkner | 84/1.26 |
| 4,116,102 | 9/1978 | Tsunoo et al. | 84/1.22 |
| 4,119,006 | 10/1978 | Whitefield | 84/1.13 |

*Primary Examiner*—S. J. Witkowski

*Attorney, Agent, or Firm*—Trexler, Wolters, Bushnell & Fosse, Ltd.

[57] ABSTRACT

In a modular, expandable organ system comprising a plurality of large scale integrated circuit (LSI) chips an LSI chip is provided which produces frequencies corresponding to notes played on an organ keyboard. Outputs of different duty cycles of rectangular waves are provided for best simulating desired sounds. Other outputs are provided in which the notes are in octave groups facilitating filtering thereof. Each group of outputs has different attack and decay characteristics respectively under the control of the organist so that similar or different types of attack and decay may be provided on different outputs.

The present LSI chip provides three generators on one chip. The chips are capable of being interconnected such that any multiple of three generators may be provided.

12 Claims, 5 Drawing Figures

LARGE SCALE INTEGRATED CIRCUIT CHIP FOR AN ELECTRONIC ORGAN

BACKGROUND OF THE INVENTION

Electronic organs have been known in the patent arts and in the marketplace for many years. Such organs heretofore generally operated on analog principles with the provision of one tone generator for each note of the organ. It has been common practice to use separate oscillators for each generator, or to provide twelve master oscillators for the top octave or one octave above the top octave with divide-by-two circuits for producing the remaining octaves of the organ. More recently it has become rather common practice to provide a single high frequency master oscillator and to divide the frequency thereof by parallel dividing circuits of different divider ratios to provide the top octave of notes, such top octave being applied to strings of divide-by-two circuits to provide the gamut of the organ.

More recently efforts have been made to produce electronic organs using digital circuits, including to some extent the elimination or minimization of redundancy in the number of tone generators combined with multiplexing of the keyboards. Digital circuits for electronic organs are relatively easily embodied in large scale integrated circuit (LSI) chips, whereas it is relatively difficult to embody analog circuits in such chips.

OBJECTS AND SUMMARY OF THE INVENTION

It is an object of the present invention to provide a large scale integrated circuit chip for use in a modular, expandable organ system, which chip is provided with a plurality of generators for a relatively low cost organ, and which can be duplicated or provided in multiple to provide substantially any number of generators for organs of greater complexity and cost.

It is another object of the present invention to provide an integrated circuit chip for use in an electronic organ, which chip has a plurality of different sets of outputs facilitating easy implementation of different organ voices.

In attaining the foregoing and other objects and advantages of the present invention a large scale integrated circuit chip is provided which receives multiplexed serial information from the organ keyboard. Three top octave synthesizers of a type generally known in the art are provided on the chip. The first generator available is assigned to the first note played on the organ manual, while the second generator is assigned to the second note, and a third generator is assigned to the third note. Each generator is capable of producing any note on the organ keyboard. Three notes is generally enough for reproducing the melody from the upper keyboard or manual of an organ, but the chip is adapted to being connected in multiple, and the present disclosure illustrates how this is done with three chips, providing a possible nine simultaneously played notes.

Each note or frequency played has a plurality of outputs. A 50% duty cycle output is provided. The frequency waves are rectangular waves, and the 50% duty cycle output thus is a square wave, well adapted to reproduction of clarinet and similar tones. The notes of the frequencies also have a 12½% duty cycle output adapted to be filtered or combined with other outputs to provide additional desired organ voices. Yet another output comprises "frequency steered" frequencies which are divided by octaves, hence providing for further handling on an octave basis, such as filtering for flute tones. The "frequency steered" output frequencies are 50% duty cycle waveforms.

THE DRAWINGS

The invention will best be understood with reference to the drawings and the accompanying specification detailing one specific form of the invention. The drawings are as follows.

DETAILED DISCLOSURE

Figure 1:
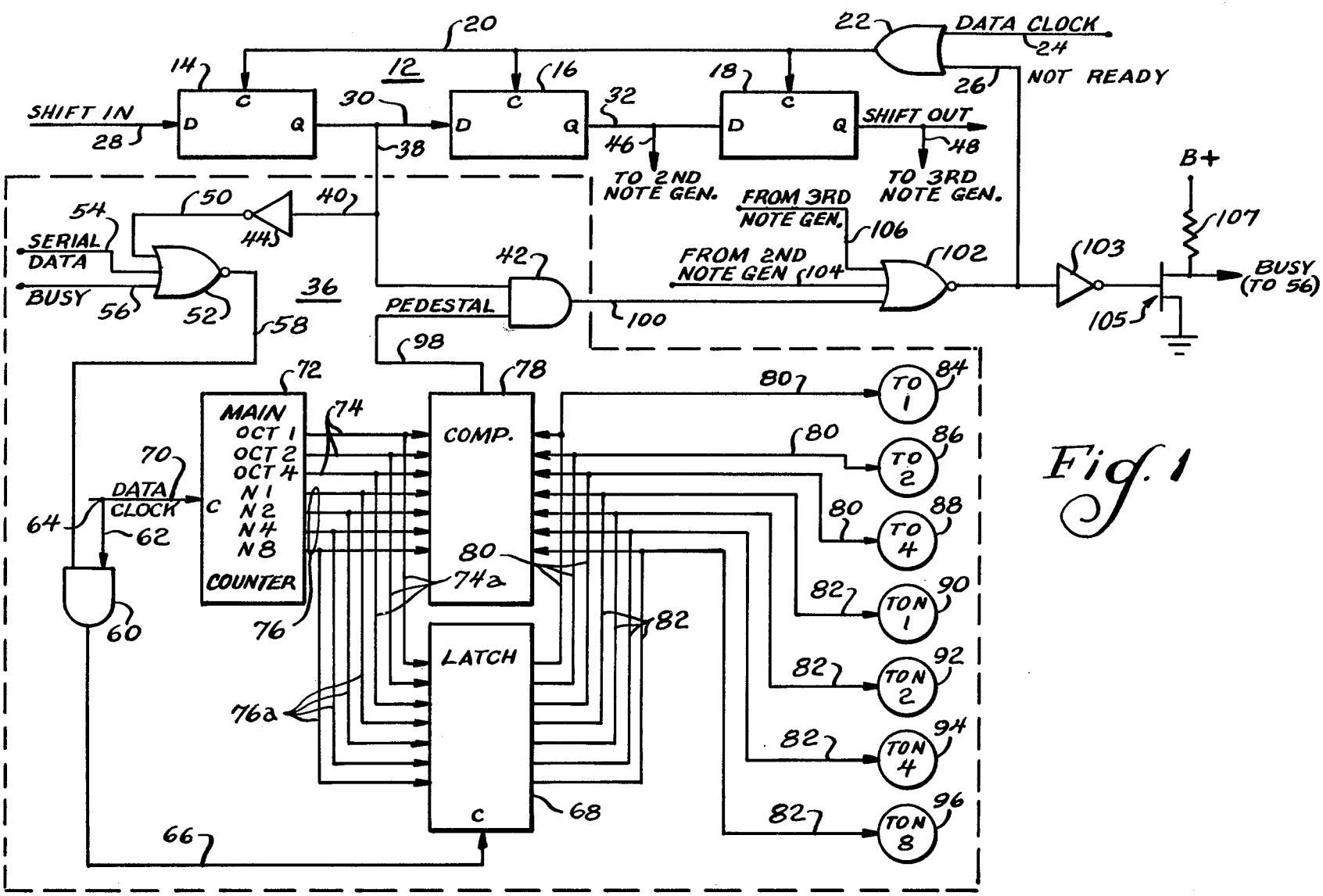
FIG. 1 is an electrical wiring diagram illustrating the assignment of tone generators (frequency generators) on the LSI chip in accordance with the principles of the present invention.

The assignment of frequency generators in connection with the large scale integrated circuit chip disclosed herein is illustrated in FIG. 1. A note assignment circuit includes a shift register 12 comprising 3 D flip-flops 14, 16 and 18. The clock input of each of these D flip-flops is provided from a conductor 20 forming the output of an OR gate 22 having two inputs, one input 24 being supplied from an external source with a data clock signal, and the other output 26 being connected to a not ready line which will be noted hereinafter.

The data input of the first flip-flop 14 is provided at 28 with a shift in signal to be noted hereinafter. The Q output is connected at 30 to the input of the second flip-flop 16, and the Q output of the second flip-flop is connected at 32 to the input of the third flip-flop 18, the Q output of which is a shift out output 34. The foregoing parts are common to the three generators of a chip. This chip comprises the B-2 chip of the modular expandable organ system disclosed in the copending application filed by Harold O. Schwartz, Dennis E. Kidd, and William R. Hoskinson on June 20, 1978 under Ser. No. 917,310 assigned to the same assignee as the present application, namely The Wurlitzer Company of DeKalb, Ill.

The actual generator assignment is in the rectangle at 36, and there are three such circuits, one for each generator. The Q output of the first D flip-flop 14 branches at 38 to a conductor 40 forming one input of an AND gate 42, and also forming the input of an inverter 44. The succeeding Q outputs also branch to second and third generators, now shown herein. Thus, the Q output 32 of the flip-flop 16 branches at 46 to the second note generator, while the Q output 34 of the flip-flop 18 branches at 48 to the third note generator.

The output 50 of the inverter 44 comprises one input of a three input NOR gate 52. The second gate input 54 comprises a serial data line receiving information originated in the multiplexing of the keyboard and various attendant switches of the organ in which the present invention is incorporated. The third input 56 comprises a busy input line of which more will be said hereinafter.

The output 58 of the NOR gate 52 comprises one input of an AND gate 60. The second AND gate input 62 comes from a data clock input 64. The output 66 of the AND gate 60 leads to the clock input of a seven bit latch 68.

The data clock input 64 branches at 70 to the appropriate input of a main counter 72. The output of the counter comprises seven parallel lines having bits of information. The first three lines 74 comprise three binary bits pertaining to octave related information. Four additional lines 76 comprise binary information as to the note within an octave. It will be appreciated that there are twelve semitones to an octave, while the lines 76 would permit binary coding up to 16. The three binary output lines 74 encode up to eight octaves. The sixty-one notes of a full organ keyboard require only six octaves, while it is common practice to provide forty-four or thirty-seven notes for a spinet organ keyboard.

The conductors 74 and 76 lead to a comparator 78. Branch conductors **74*a* and 76*a* lead to the inputs of the latch 68. There are three output conductors 80 from the latch providing octave information, and four output conductors 82 providing note information. These lines are connected as inputs to the comparator, and are respectively connected to octave output connections 84, 86 and 88 leading out of the generator portion 36. Similarly, the conductors 82 lead to note output connectors 90, 92, 94 and 96**.

When a comparison is found in the comparator 78 there is an output on a conductor 98 connected to the second input of the AND gate 42.

The output 100 of the AND gate 42 comprises one input of a NOR gate 102. This is a three input gate, and the second input 104 is connected to an output of the second note generator corresponding to the output 100. The third input 106 is similarly connected to an output from the third note generator.

When power is first turned on in an organ utilizing the present chip a one appears on the Q output of the D flip-flop 14. This provides a "0" on the conductor 50 into the OR gate 52. Nothing appears on the busy line at present. Hence the serial data input at 54 conveys multiplexed information from the keyboard through the NOR gate 52. If on a scan of the keyboard, a keyswitch is detected active, this bit of serial data allows one pulse of the data clock input at 64 through the AND gate 60 to clock the latch 68, so that the state on the main counter is held in the latch at that particular time period. Accordingly, there is a compare signal from the comparator.

A one appears on the pedestal line 98, thereby providing two "1's" to the AND gate 42, thus providing a "0" out of the NOR gate 102, thereby enabling the data clock signal 24 to pass through the OR gate 22 to clock the shift register.

The one appearing at the Q output of the first flip-flop 14 thus moves to the Q output of the second flip-flop 16. A "0" appears on the branch conductor 38, and the output of the AND gate 42 goes to "0". If it is assumed for the moment that no other keys have yet been played, then there is a "1" output from the NOR gate 102 and the stream of the data clock through the OR gate 22 is blocked.

The output of comparator 78 on line 98 has a branch conductor connected to the gate of a field effect transistor (FET) 105. The source of FET 105 is connected to ground and the drain is connected through a resistor 107 to a voltage source B+ and to busy line 56 in common with the corresponding line on other B-2 chips present in the system.

The second generator is then set in the same manner as the first. An active state on the busy line 56 is established, and serial data is blocked from entering the NOR gate 52 at the time slot of the key switch of the first note that put the active signal on the busy line. When the second generator has been assigned there are two active states on the busy line, etc. There can be as many busy signals as there are numbers of generators, vis. three on a single B-2 chip, or nine for three B-2 chips.

The four bits of note data appearing at 90, 92, 94 and 96 are utilized to cause a top octave synthesizer to produce the proper frequency for the note played as if it were played in the top octave. The frequency thus selected appears on a line 108 in FIG. 2 leading to a string of five divide-by-two dividers 110. The frequency selected line 108 also is connected directly to an octave select one of six selector 112. The outputs 114 of the divide-by-two string 110 also are connected to the one of six selector 112.

Figure 2:
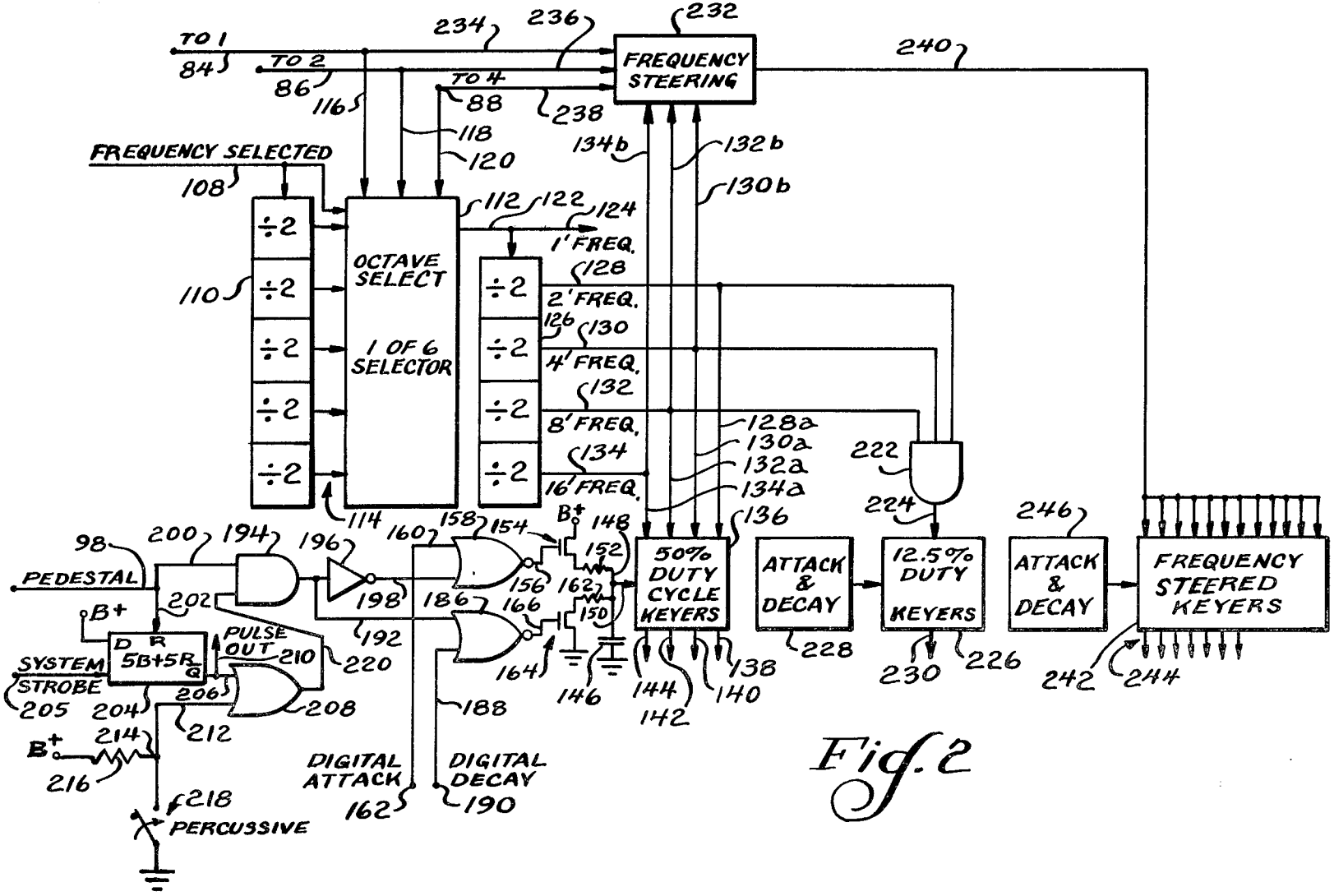
FIG. 2 is another electrical wiring diagram illustrating the output groupings of frequencies as respectively keyed and with respective attack and decay characteristics.

The three bits of information as to the proper octave are connected as indicated at 84, 86, and 88 in FIG. 2, corresponding to the same numbered conductors in FIG. 1. There are respectively connected by conductors 116, 118, and 120 to the octave select one of six selector 112.

The output of the one of six selector therefore appears at 122 at the proper frequency in the proper octave. The output continues at 124 as the one foot frequency of the particular note, and is also connected to a string of four divide-by-two circuits 126. These circuits have respective outputs 128, 130, 132 and 134 which comprise the two foot frequency, the four foot frequency, the eight foot frequency, and the sixteen foot frequency of the note played. Branch conductors from the foregoing conductors comprise conductors **128*a*, 130*a*, 132*a* and 134*a* leading to a 50% duty cycle keyer circuit 136 having corresponding outputs 138, 140, 142 and 144** at the different footages.

The 50% duty cycle keyers are provided with a digital attack and decay feature as specifically disclosed in the copending patent application of William R. Hoskinson filed June 20, 1978 under Ser. No. 917,308 assigned to the same assignee as the present application, namely The Wurlitzer Company of DeKalb, Ill. The digital attack and decay circuit includes a capacitor 146 exterior of the chip and having one plate or side thereof connected to ground. It will be understood herein that when reference is made to "ground" it may actually be at the nominal ground, or at a positive or negative fixed voltage away from ground, as is common in LSI circuit technology. The opposite side or plate of this capacitor is connected to a junction 148, which is connected at 150 to the 50% duty cycle keyers.

The junction 148 is connected through a resistor 152 to the source of a FET, the drain thereof being connected to B+ potential. The gate or control element is connected at 156 to the output of a NOR gate 158 having one input at 160 connected to an external pin 162 having a digital attack clock connected thereto.

The junction 148 also is connected through a resistor 162 to the drain of a second FET 164, the source thereof being connected to ground. The control element or gate is connected to the output 166 of a NOR gate 186 having one input 188 thereof connected to an external pin 190 which in turn is connected to a digital decay clock.

The resistors 152 and 162 are conveniently shown as discrete resistors, but in an actual circuit comprise the inherent resistance characteristics of field effect transistors.

The second input 192 of the NOR gate 186 is connected to the output of a two input AND gate 194. The output of this AND gate is also connected through an inverter 196 to the input 198 of the NOR gate 158. The AND gate 194 has one input 200 thereof connected to the pedestal line 202 from the TOS assignment logic. The input 200 and pedestal line 202 are also connected by a conductor to the reset input of a five bit shift register 204. The data input of the shift register 204 is connected to B+, while the clock input is connected to a conductor 205 on which the system strobe signal appears which is a part of the entire organ circuit to insure proper time relation of the various components thereof. The Q output of the shift register 204 is not used, while the $\overline{Q}$ output is connected through a conductor 206 to one input of an OR gate 208. The conductor 206 also has a lead 210 providing a pulse out of the circuit. The other input 212 of the OR gate 208 is connected to a junction 214 which leads through a resistor 216 to B+ potential. The junction 214 also is connected to the fixed contact of a single pole-single throw switch 218, having the movable contact thereof connected to ground. This switch may be on the keyboard of the organ for manual operation, or it may be a remote electronic switch controlled by the multiplexed data of the keyboard.

The switch 218 is closed for playing in the percussive mode. This provides a "0" from the switch which combines with a "1" from the $\overline{Q}$ output of the shift register 204 to provide a "1" out of the OR gate 208 on a conductor 220 leading to the second input of an AND gate 194. With the pedestal line 202 up, two "1's" are therefore entered into the AND gate 194 to produce a "1" out of the line 192. This blocks the digital decay into the NOR gate 186 and turns on the digital attack through the NOR gate 158.

As is more fully disclosed in the aforesaid Hoskinson copending application a digital attack is effected by a variable duty cycle wave which is under the control of the organist. The duty cycle as applied at 162 determines what percentage of the time the FET 154 will be conductive to charge from B+ through that FET to the capacitor 146. The digital decay operates in a similar fashion, having a variable duty cycle wave applied at 190, and determining the time during which the FET 164 is conductive to discharge the capacitor 146.

When the pedestal line 202 is a "1" the shift register 204 will clock "1's" therethrough since the data input is held on B+. A "0" on the reset input of shift register 204 at line 202 resets all stages. The length of the shift register determines the time delay until the Q output goes to a "0".

At this time the "0" through the OR gate 208 with the "0" from the percussion switch puts a "0" into the AND gate 198, whereby the output of the AND gate 194 goes to "0". This allows the digital decay signal on the input line 198 of the NOR gate 186 to pass through to discharge the capacitor 146. The "0" out of the AND gate provides a "1" on the input line 198 to the NOR gate 158, thereby disabling it from passing the digital attack signal 162. The B+ or "1" input on the data input of the shift register 204 is stepped through the register by the system strobe 205 input to the clock input of the shift register 204. One pulse appears for each scan frame of the multiplexer.

The turn off of the digital attack and turning on of the digital decay as just described occurs whether or not the organist holds a key down. If it is held down there is a one on the pedestal line 202, but if the key is released a "0" appears on this line. Thus, since it is the "0" out of the AND gate 194 that turns off the digital attack and turns on the digital decay, it is apparent that the transition from digital attack to digital decay will occur whether or not the key is held down. The output conductors 128, 130, and 132 of the divide-by-two string 126 are connected to the inputs of a three input AND gate 222 the output 224 of which is connected to 12½% duty cycle keyers 226. Attack and decay circuits 228 similar to those just described in connection with the 50% duty cycle keyers are connected to the 12½% duty cycle keyers 226. The keyers 226 have an output 230.

Branch conductors **130*b*, 132*b*, and 134*b* from the divide-by-two string 126 outputs, 130, 132 and 134 respectively lead to a frequency steering circuit 232. This circuit also has inputs at 234, 236 and 238 respectively from the octave selector inputs 84, 86 and 88. The frequency steering circuits provide a multiple output 240 connected to frequency steered keyers 242 to provide a plurality of frequency steered outputs 244. An attack and decay circuit 246 is connected to the frequency steered keyers 242**, and is generally similar to that discussed heretofore in connection with the attack and decay circuits for the 50% duty cycle keyers. The decay is substantially identical from an external pin. However, the attack is selected as one of two possible valves in accord with a switch in the keyboard matrix and appears as a bit of information on the serial data line.

Since each output group has an individual attack and decay circuit it is possible to control the attacks and decays differently for each output group playing the same note. This can provide many interesting and unusual effects not previously available in an electronic organ.

Figure 3:
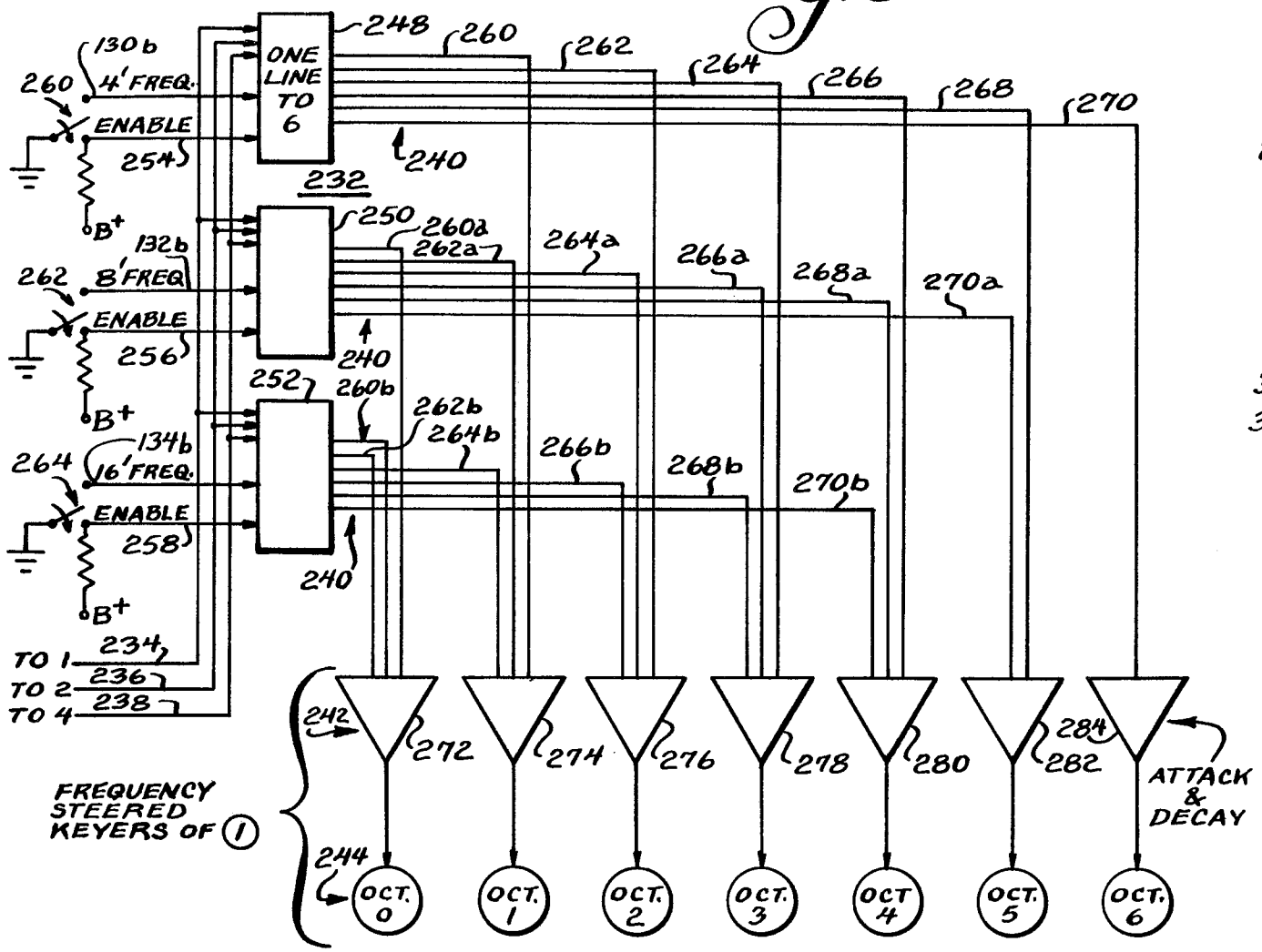
FIG. 3 is an electrical wiring diagram illustrating the frequency steering, shown generally in FIG. 2.

The frequency steering and keying thereof will best be understood with reference to FIG. 3. The frequency steering circuit 232 will be seen to comprise three one line to six lines demultiplexers 248, 250 and 252. Each of the one to six circuits have inputs from the octave information carrying conductors 234, 236 and 238. The circuits respectively have inputs of the four foot frequency **130*b*, and 132*b* of the eight foot frequency, and 134*b* of the sixteen foot frequency. Each such circuit also has an enable input line, respectively 254, 256 and 258. Each such line is connected to the fixed contact of a respective enable switch 260, 262 and 264. Each enable line is connected through a resistor to B+, and the movable contact of each of the switches 260, 262 and 264 is connected to ground. Operation of these respective switches enables the three one to six circuits 248, 250 or 252**.

There are seven frequency steered keyers 242, respectively 272 for octave 0 of the organ, 274 for octave 1, 276 for octave 2, 278 for octave 3, 280 for octave 4, 282 for octave 5, and 284 for octave 6. The outputs 244 are the seven corresponding octaves as labeled in FIG. 3. Each of the keyers 242 in FIG. 3 will be understood as including the respective attack and decay controls.

The connections from the respective one to six circuits to the keyers readily may be followed, and it will be seen that there are three inputs to each up through octave four, but only two inputs at octave 5, and one at octave 6. Hence, only the four foot frequency appears in octave 6 if its enable switch is properly operated, while both four foot and eight foot frequencies can play in octave 5. Octave 0 can play only 16 and 8 foot frequencies, while octaves 1 through 4 can play any or all of the 4 foot, 8 foot, and 16 foot frequencies. This grouping is clarified by the labelling of the four foot frequencies as 244, the eight foot frequencies as 245, and the sixteen foot frequencies as 247. Since only a one octave span of frequencies appears on each of the outputs 244, it is possible to filter the waves thereon on an octave by octave basis. For example, it is recognized that a flute tone is substantially only fundamental with no significant harmonic content. A filter readily can be constructed that will permit passage only of the fundamental of a particular note with the input being a square wave. However, as more and more frequencies are put into a filter, it becomes less effective away from its center position. Handling of frequencies on an octave basis as is possible herein allows a reasonable number of filters to do a very effective job of filtering.

Figure 4:
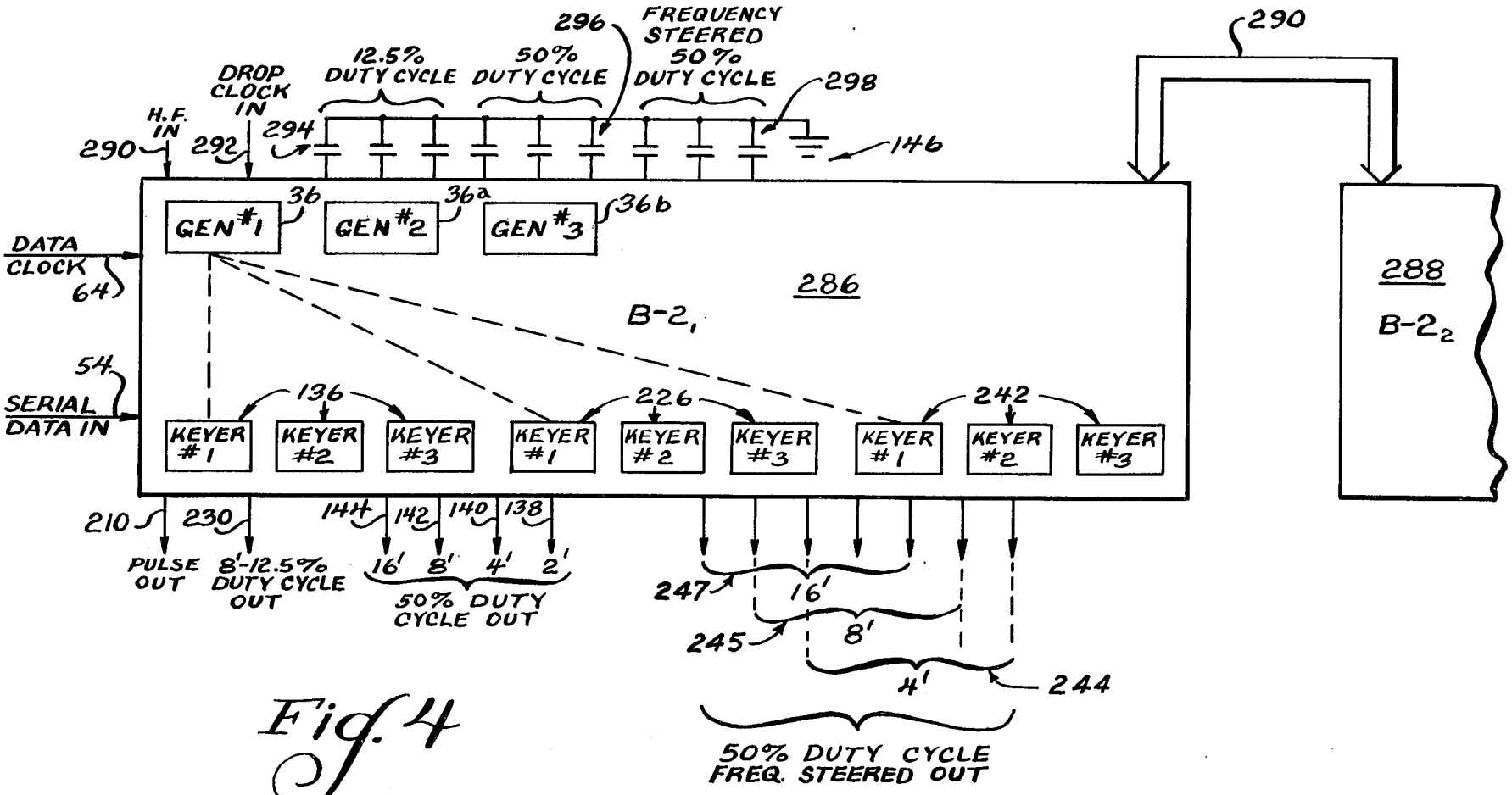
FIG. 4 is a partial schematic diagram illustrating portions of the LSI chip forming the subject matter of the present invention.

Certain aspects of the present invention are shown or reshown in FIG. 4 wherein a first B-2 chip 286 is interconnected with a second B-2 chip 288 by means of a jumper 290 interconnecting the cascade pins on the respective chips. The chip 286 is provided with a high frequency input 291 which, by way of example, may be on the order of 4 MHz. A drop clock frequency in is applied at 292 and may by way of example may be on the order of 5 KHz. The purpose of the drop clock input is to eliminate certain pulses from the high frequency input to detune the high frequency applied to the generators, as set forth in greater detail in the copending patent application of Anthony C. Ippolito and William R. Hoskinson, filed June 20, 1978 under Ser. No. 917,296 assigned to the same assignee as the present application, namely The Wurlitzer Company of DeKalb, Ill. Capacitors corresponding to the capacitor 146 in connection with the digital attack and decay will be seen to be in three groups, one group 294 of three capacitors for the 12½% duty cycle wave. The second group 296 of three capacitors is for the three notes of the 50% duty cycle wave. Finally, the group of three capacitors 298 is interconnected with the three notes that may be played on the 50% duty cycle frequency steered. It wil now perhaps be more clear that each of the three notes that may be played from any one B-2 chip has separate attack and decay capacitors for each output thereof, thereby allowing individual attack and decay with the production of desirable and novel characteristics not heretofore available in electronic organs.

The frequency generator number 1 is again identified by numeral 36. Generator #2 is indicated as 36*a*, and generator #3 as 36*b*.

Three sets of keyers 136, 226, and 242 are shown in block fashion in FIG. 4, there being three keyers to each set. As is indicated by the broken lines the first generator is connected to each of the first keyers.

The data clock in is again shown at 64 while the serial data in is shown at 54. The pulse out 210 has many uses such as the initial detuning of a dynamic filter, or triggering of external rhythm devices. The respective frequency outputs are shown along the bottom of the chip 286 with the same numerals as used heretofore, thereby rendering repetition of description unnecessary.

Figure 5:
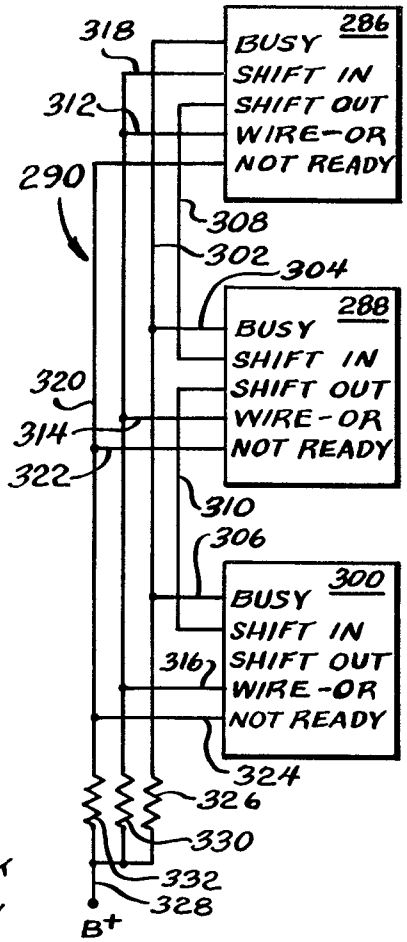
FIG. 5 is an electrical wiring diagram showing the manner in which a plurality of chips can be wired together to form additional generators.

The interconnecting conductors shown generally at 290 in FIG. 4 comprise five individual conductors, seen better in FIG. 5. Three chips are shown in FIG. 5, the previously numbered chips 286 and 288, and the third one being 300.

Each of the three chips has five cascading pins. These pins are identified by the respective function names in chip 286, and by similar initials in chips 288 and 300. These pins comprise a busy pin, the three busy pins being connected by conductors 302, 304, and 306. Each chip also has a shift in pin, and also a shift out pin. A shift out pin of chip 286 is connected by a conductr 308 to the shift in pin of chip 288. Similarly, the shift out pin of chip 288 is connected by a conductor 310 to the shift in pin of chip 300.

The fourth cascading pin on each chip is a wire-or and these are connected in common by conductors 312, 314, and 316. The shift in pin of chip 286 is connected by a conductor 318 to the wire-or conductor 318.

The fifth cascading pin of each chip comprises a not ready pin, and these are all interconnected by conductors 320, 322, and 324.

In addition to the foregoing the interconnecting lines of the busy pins are connected through a resistor 326 to a B+ bus 328. The wire-or pins are also connected through a resistor 330 to the B+ bus, while the not ready pins are connected through a resistor 332 to the B+ bus.

The organ system can operated with but one B-2 chip in which case the wire-or is connected to the shift in pin. These two pins are connected through a resistor to B+ as just disclosed. The busy pin and the not ready pin are also connected through their respective resistors to the B+ bus, while the shift out pin is not connected.

The use of the five cascading pins allows for expanding the system in groups of three notes. With three B-2 chips as in FIG. 5 there is a total of nine notes or generators available. The wire-or identifies the first generator of that chip that it is to be the first or number 1 generator in the system. Assignment of generators #2 and #3 follows the shifting of the shift register 12 in FIG. 1.

After the "1" in the shift register has been shifted completely through the register to the shift out 34 thereof, there are no further "1's" left in that system, but the "1" succeeds to the shift in pin of the second chip 288, through its shift register, and out on its shift out pin to the shift in pin of the third generator chip 300. Since there are no more chips in accordance with the illustration of FIG. 5 the shift out pin of chip 300 remains unconnected. The wire or pin of each chip is connected to the successive output branches 38, 46 and 48 of the shift registers 12. The not ready pins are respectively interconnected with the line 26 from the output of the NOR gate 106 in each chip.

The circuits shown may be embodied either using separate integrated circuits connected in the manner shown or a single integrated circuit incorporating all of the elements shown. Such an integrated circuit may be fabricated using process techniques well known in the semiconductor industry, desirably in metal oxide silicon (MOS) form. Since such techniques do not form a part of this invention, they will not be described in futher detail.

The specific example of the present invention as herein shown and described is for illustrative purposes. Various modifications will no doubt occur to those skilled in the art, and will be understood as forming a part of the present invention insofar as they fall within the spirit and scope of the appended claims.

The invention is claimed as follows:

1. A large scale integrated circuit chip for use in an electronic organ or the like having a keyboard including a plurality of keys and a plurality of key switches respectively controlled by said keys, comprising a plurality of frequency generating means responsive to the actuation of said keyswitches for generating frequencies corresponding to musical tones, each of said generators being capable of generating a frequency corresponding to any note of said electronic organ or the like, means interconnecting said frequency generators with said keyswitches for selectively causing said generators to generate frequencies corresponding to musical tones, a plurality of groups of keying means connected to said frequency generators for keying frequencies out of said chip, separately controllable attack and decay controlling means for each group of said keying means, and said attack and decay controlling means being further responsive to each frequency generator means independently of the other said keying means within each group thereof.

2. An integrated circuit chip as set forth in claim 1 wherein the plurality of groups of keying means comprises a multiple of the number of frequency generating means.

3. An integrated circuit chip as set forth in claim 1 and further including frequency divider means associated with each frequency generating means for producing groups of frequencies of different footages from each frequency generating means, said keying means respectively connected to said frequency generating means to key frequencies corresponding to said different footages.

4. An integrated circuit chip as set forth in claim 3 wherein said frequency generating means generate rectangular waves, and further including combining means for combining certain of said waves to produce a wave of different character, said keying means including means for separately keying said wave of different character.

5. An integrated circuit chip as set forth in claim 4 wherein said wave of different character comprises a rectangular wave.

6. An integrated circuit chip as set forth in claim 5 wherein the combining means comprises a gate.

7. An integrated circuit chip as set forth in claim 1 including a plurality of outputs each transmitting note frequencies in only one octave, said keying means including a keying means for each of said octave outputs, and means interconnecting said frequency generating means and said octave keying means for respectively connecting octave frequencies to said octave keying means.

8. The combination of a plurality of integrated circuit chips each in accordance with claim 1 and furher including cascading means interconnecting said plurality of circuit chips for increasing the number of frequency generators available.

9. A large scale integrated circuit chip for use in an electronic organ or the like having a keyboard including a plurality of keys and a plurality of keyswitches respectively controlled by said keys, comprising a plurality of frequency generating means for generating frequencies corresponding to musical tones, each of said generating means being capable of generating a frequency corresponding to any note of said electronic organ or the like, means interconnecting said frequency generators with said keyboard and said keyswitches for selectively causing said generators to generate frequencies corresponding to musical tones, a first plurality of keying means connected to said frequency generators for keying frequencies out of said chip, a plurality of said keying means each transmitting note frequencies in only one octave, second keying means for each of said octave keying means, and means interconnecting said frequency generating means and said octave keying means for respectively connecting octave frequencies to said octave keying means.

10. An integrated circuit chip as set forth in claim 9 wherein said frequency generating means generates a first substantially rectangular wave, and further comprising means interconnected with each of said frequency generating means to provide output waves of different footages, means for combining certain of said output waves to provide a second substantially rectangular wave having a different duty cycle than said first rectangular wave, and a plurality of keying means for said waves of different footages and for said second wave.

11. A plurality of like large scale integrated circuit chips for use in an electronic organ or the like having a keyboard including a plurality of keys and a plurality of keyswitches respectively controlled by said keys, each chip comprising a plurality of frequency generating means for generating frequencies corresponding to musical tones, each of said generating means being capable of generating a frequency corresponding to any note of said electronic organ or the like, means interconnecting said frequency generating means with said key switches for selectively causing said generators to generate frequencies corresponding to musical tones, a plurality of keying means connected to said frequency generators for keying frequencies out of said chip, and means for interconnecting said plurality of chips such that each frequency generating means of said plurality thereof on each of said plurality of chips is actuatable by said keyswitches of said keyboard, thus increasing the number of frequency generating means associated with said keyboard.

12. A plurality of large scale integrated circuit chips as set forth in claim 11 wherein each chip further has a shift register with the respective stages thereof connected to respective generators, the last stage of the shift register in the first chip being connected to the first stage of the shift register in the next chip.

* * * * *

UNITED STATES PATENT AND TRADEMARK OFFICE

CERTIFICATE OF CORRECTION

PATENT NO. : 4,203,337

DATED : May 20, 1980

INVENTOR(S) : HAROLD O. SCHWARTZ and DENNIS E. KIDD

It is certified that error appears in the above-identified patent and that said Letters Patent are hereby corrected as shown below:

Column 2, line 62, change "now" to --not--;

Column 5, line 59, change "Q" to --$\overline{Q}$--;

Column 8, line 14, change "conductr" to --conductor--;

Column 8, line 21, change the second occurrence of "318" to --316--;

Column 8, line 31, after "can" insert --be--;

Column 9, line 59, change "furher" to --further--.

Signed and Sealed this

*Sixteenth* Day of *September 1980*

[SEAL]

*Attest:*

SIDNEY A. DIAMOND

*Attesting Officer*

*Commissioner of Patents and Trademarks*